US010381139B2

(12) United States Patent
Nagata et al.

(10) Patent No.: US 10,381,139 B2
(45) Date of Patent: Aug. 13, 2019

(54) W-CONTAINING R—FE—B—CU SINTERED MAGNET AND QUENCHING ALLOY

(71) Applicants: Xiamen Tungsten Co., Ltd., Fujian (CN); Fujian Changting Golden Dragon Rare-Earth Co., Ltd, Fujian Province OT (CN)

(72) Inventors: Hiroshi Nagata, Fujian (CN); Rong Yu, Fujian (CN); Qin Lan, Fujian (CN)

(73) Assignees: Xiamen Tungsten Co., Ltd., Fujian (CN); Fujian Changting Golden Dragon Rare-Earth Co., Ltd, Fujian Provice OT (CN)

( * ) Notice: Subject to any disclaimer, the term of this patent is extended or adjusted under 35 U.S.C. 154(b) by 239 days.

(21) Appl. No.: 15/185,430

(22) Filed: Jun. 17, 2016

(65) Prior Publication Data

US 2016/0300648 A1 Oct. 13, 2016

Related U.S. Application Data

(63) Continuation of application No. PCT/CN2015/075512, filed on Mar. 31, 2015.

(30) Foreign Application Priority Data

Mar. 31, 2014 (CN) ..... 2014 1 0126926

(51) Int. Cl.
*H01F 1/057* (2006.01)
*H01F 1/053* (2006.01)
(Continued)

(52) U.S. Cl.
CPC ..... *H01F 1/0536* (2013.01); *C22C 38/002* (2013.01); *C22C 38/005* (2013.01);
(Continued)

(58) Field of Classification Search
CPC ..... H01F 1/057; H01F 1/0577
(Continued)

(56) References Cited

U.S. PATENT DOCUMENTS 5,223,047 A 6/1993 Endoh et al.
5,431,747 A 7/1995 Takebuchi et al.
(Continued)

FOREIGN PATENT DOCUMENTS

CN 1166677 A 12/1997
CN 1409332 A 4/2003
(Continued)

OTHER PUBLICATIONS

International Search Report issued in International Application No. PCT/CN2014/092225; dated Feb. 26, 2015 (5 pages).
(Continued)

*Primary Examiner* — Brian D Walck
(74) *Attorney, Agent, or Firm* — Cooper Legal Group, LLC

(57) ABSTRACT

The present invention discloses a W-containing R—Fe—B—Cu serial sintered magnet and quenching alloy. The sintered magnet contains an $R_2Fe_{14}B$-type main phase, the R being at least one rare earth element comprising Nd or Pr; the crystal grain boundary of the rare earth magnet contains a W-rich area above 0.004 at % and below 0.26 at %, and the W-rich area accounts for 5.0 vol %~11.0 vol % of the sintered magnet. The sintered magnet uses a minor amount of W pinning crystal to segregate the migration of the pinned grain boundary in the crystal grain boundary to effectively prevent abnormal grain growth and obtain significant improvement. The crystal grain boundary of the quenching alloy contains a W-rich area above 0.004 at % and below 0.26 at %, and the W-rich area accounts for at least 50 vol % of the crystal grain boundary.

13 Claims, 3 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/12*** | (2006.01) |
| ***C22C 38/16*** | (2006.01) |
| *H01F 41/02* | (2006.01) |

(52) U.S. Cl.
CPC ..... *C22C 38/06* (2013.01); *C22C 38/10* (2013.01); *C22C 38/12* (2013.01); *C22C 38/16* (2013.01); *H01F 1/057* (2013.01); *H01F 1/0577* (2013.01); *H01F 41/0293* (2013.01)

(58) Field of Classification Search
USPC ..... 148/302
See application file for complete search history.

(56) References Cited

U.S. PATENT DOCUMENTS

| | | | |
|---|---|---|---|
| 6,214,288 | B1 | 4/2001 | Kusunoki et al. |
| 8,152,936 | B2 | 4/2012 | Tsubokura et al. |
| 2005/0098239 | A1 | 5/2005 | Kuniyoshi et al. |
| 2009/0035170 | A1 | 2/2009 | Nakajima et al. |
| 2009/0072938 | A1 | 3/2009 | Nakajima et al. |
| 2011/0095855 | A1* | 4/2011 | Kuniyoshi ..... H01F 1/0577 335/302 |
| 2011/0171056 | A1 | 7/2011 | Blank et al. |
| 2012/0182107 | A1 | 7/2012 | Ozeki et al. |

FOREIGN PATENT DOCUMENTS

| | | | |
|---|---|---|---|
| CN | 101256859 | A | 9/2008 |
| CN | 101320609 | A | 12/2008 |
| CN | 101325109 | A | 12/2008 |
| CN | 102067249 | A | 5/2011 |
| CN | 102511071 | A | 6/2012 |
| CN | 102956337 | A | 3/2013 |
| CN | 103050267 | A | 4/2013 |
| CN | 103123839 | A | 5/2013 |
| CN | 103903823 | A | 7/2014 |
| DE | 19945942 | A1 | 4/2001 |
| EP | 0258609 | A2 | 3/1988 |
| EP | 0302395 | A1 | 2/1989 |
| EP | 1164599 | A2 | 12/2001 |
| EP | 2302646 | A1 | 3/2011 |
| EP | 2740551 | A1 | 6/2014 |
| JP | H06340902 | A | 12/1994 |
| JP | 07-045412 | | 2/1995 |
| JP | 2720040 | B2 | 2/1998 |
| JP | 2000303153 | A | 10/2000 |
| JP | 2002064010 | A | 2/2002 |
| JP | 2007136543 | A | 6/2007 |
| JP | 2008214747 | A | 9/2008 |
| JP | 2008231535 | A | 10/2008 |
| JP | 2012028704 | A | 2/2012 |
| JP | 2013070062 | A | 4/2013 |
| JP | 2013-110387 | A | 6/2013 |
| JP | 2013216965 | A | 10/2013 |
| JP | 2013219322 | A | 10/2013 |
| JP | 2013236071 | A | 11/2013 |
| JP | 2014-27268 | A | 2/2014 |
| JP | 2014132628 | A | 7/2014 |
| KR | 100496173 | B1 | 6/2005 |
| WO | 2009/122709 | A1 | 10/2009 |
| WO | 2009/150843 | A1 | 12/2009 |
| WO | 2009004994 | A1 | 8/2010 |
| WO | 2013122256 | A1 | 5/2015 |
| WO | 2015022945 | A1 | 3/2017 |

OTHER PUBLICATIONS

Written Opinion issued in International Application No. PCT/CN2014/092225; dated Feb. 26, 2015 (9 pages).
English translation of Office Action issued in corresponding CN Application No. 201580002027 dated Aug. 11, 2017 (5 pages).
English translation of Notification to Grant issued in corresponding CN Application No. 201580002027 dated Dec. 4, 2017 (2 pages).
English translation of Supplemental Search Report issued in corresponding CN Application No. 201580002027 dated Nov. 27, 2017; Screen shot of dates from Global Dossier (4 pages).
Office Action issued in corresponding Japanese Application No. 2016-560501 dated Oct. 30, 2017, and English translation thereof (16 pages).

* cited by examiner

W-CONTAINING R—FE—B—CU SINTERED MAGNET AND QUENCHING ALLOY

FIELD OF THE INVENTION

The present invention relates to the field of magnet manufacturing technology, and in particular to a rare earth sintered magnet and a quenching alloy with a minor amount of W and a low content of oxygen.

BACKGROUND OF THE INVENTION

Recent years, three new major techniques for rare earth sintered magnet (comprising $R_2Fe_{14}B$-type main phase) have been rapidly applied to the technical processes of mass production, the details are as follows:

1. Magnet manufacturing process with low oxygen content: reducing the oxygen content of the magnet that deteriorates the sintering property and coercivity as much as possible;

2. Raw material manufacturing process: the raw material alloy is manufactured by strip casting method as represented, wherein at least one part of the alloy is manufactured by quenching method;

3. By adding a minor amount of Cu, it is capable of obtaining a higher value of coercivity within a wider temperature range, and mitigating the dependency of coercivity and quenching speed (from public report JP2720040 etc).

It is easily capable of acquiring an extremely high property by the additive action of increasing the amount of Nd-rich phase in the crystal grain boundary and the dispersibility after combining the three new techniques for mass production.

However, the number of low melting liquid phase is increased during the sintering process as Cu is added into the low-oxygen magnet; and the shortages of easy occurrence of abnormal grain growth and the significant decreasing of the squareness (SQ) arise while the sintering property is significantly improved at the same time.

SUMMARY OF THE INVENTION

The objective of the present invention is to overcome the shortage of the conventional technique, and discloses a W-containing $R_2Fe_{14}B$ serial main phase, the sintered magnet uses a minor amount of W pinning crystal to segregate the migration of the pinned grain boundary in the crystal grain boundary to effectively prevent abnormal grain growth (AGG) and obtain a significant improvement.

The technical solution of the present invention is as below:

A W-containing R—Fe—B—Cu serial sintered magnet, the sintered magnet comprises an $R_2Fe_{14}B$-type main phase, the R being at least one rare earth element comprising Nd or Pr, wherein the crystal grain boundary of the rare earth magnet comprises a W-rich area with a W content above 0.004 at % and below 0.26 at %, the W-rich area is distributed with a uniform dispersion in the crystal grain boundary, and accounting for 5.0 vol %~11.0 vol % of the sintered magnet.

In the present invention, the crystal grain boundary is the portion except the main phase ($R_2Fe_{14}B$) of the sintered magnet.

In a preferred embodiment, the magnet is composed by the following raw material:

12 at %~15.2 at % of R, 5 at %~8 at % of B, 0.0005 at %~0.03 at % of W, 0.05 at %~1.2 at % of Cu, below 5.0 at % of X, the X being selected from at least one element of Al, Si, Ga, Sn, Ge, Ag, Au, Bi, Mn, Nb, Zr or Cr, the total content of Nb and Zr is below 0.20 at % when the X comprises Nb and/or Zr, the balance being 0 at %~20 at % of Co, Fe and inevitable impurities, and the impurities comprising 0 and with a content of 0.1 at %~1.0 at %.

The at % of the present invention is atomic percent.

The rare earth element stated by the present invention is selected from at least one element of Nd, Pr, Dy, Tb, Ho, La, Ce, Pm, Sm, Eu, Gd, Er, Tm, Yb, Lu or yttrium.

It is difficult to guarantee the accuracy of the detecting result for the trace elements in the previous research as the restriction of the detecting device. Recently, as the promotion of the detecting technique, the detecting device with a higher accuracy has appeared, such as inductively coupled plasma mass spectrometer ICP-MS, field emission-electron probe micro-analyzer FE-EPMA and so on. Therein, ICP-MS (7700x type, Agilent) is capable of detecting an element with a content of 10 ppb. FE-EPMA (8530F type, JEOL) adopts its field emission gun, and a very thin electric beam may be still guaranteed when works under a high current, and the highest resolution reaches 3 nm, the detecting limit for the content of the micro-region element reaches around 100 ppm.

The present invention is different from the conventional tendency which adopts a higher addition of high melting point metallic raw material Zr, Hf, Mo, V, W and Nb (generally being limited around 0.25 at %), forms amorphous phases and isotropic quenching phases, consequently deteriorates the crystal orientation degree and significantly reduces Br and (BH)max; the present invention comprises a minor amount of W, that is, with a content below 0.03 at %, because W is a non-magnetic element, the dilution effect is lower, and hardly contains amorphous phases and isotropic quenching phases in the quenching magnet alloy, therefore, a minor amount of W of the present invention do not reduce Br and (BH)max absolutely, while increasing Br and (BH) max instead.

Referred from the present literature and report, W has a greater solid solubility limit, therefore the minor amount of W may dissolve evenly in the molten liquid. However, as the ionic radius and electronic structure of W are different from that of the main constitution element of rare earth element, Fe, and B; therefore there is almost no W in the main phase of $R_2Fe_{14}B$, W concentrates toward the crystal grain boundary with the precipitation of the main phase of $R_2Fe_{14}B$ during the cooling process of the molten liquid. When the composition of the raw material is prepared, the composition of rare earth type is designed as more than the composition of the main phase alloy, consequently the content of the rare earth (R) is greater in the crystal grain boundary, in other words, R-rich phase (also named as Nd-rich phase) comprises most of W (detected and verified with FE-EPMA, most of the minor amount of W is existed in the crystal grain boundary), after W dissolves in the grain boundary, as the compatibility of W element, rare earth element and Cu are relatively poor, W of the R-rich phase of the grain boundary is precipitated and separated during the cooling process, when the solidification temperature of the grain boundary reaches around 500~700° C., W may be precipitated minorly in a manner of uniform dispersion as W is positioned in the region wherein B, C and O are diffused slowly and which is difficult to form compound with a large size comprising W2B, WC and WO. After crushing the raw material alloy, entering the compacting and sintering processes, the main phase grain may grow during the compacting and sintering processes, however, as W (pinning effect) existing in the crystal grain boundary performs a pinning effect for the migration of the grain boundary, which may effectively prevent the formation of abnormal grain growth and has a very favorable effect for improving the properties of SQ and Hcj. Take the example of FIG. 1 illustrating the principle of pinning effect for the migration of grain boundary, the black spot of FIG. 1 represents W pinning crystal, 2 represents alloy molten liquid, 3 represents grain, the arrow represents the growth direction of the grain, as illustrated in FIG. 1, during the grain growth process, W pinning crystal substance accumulates on the surface of the growth direction of the grain, comparts the substance migration process between the grain and the external circumstance, and therefore the growth of the grain is blocked.

Similarly, because W is precipitated minorly and uniformly, the occurrence of AGG is prevented in the rare earth intermetallic compound $R_2Fe_{14}B$, and squareness (SQ) of the manufactured magnet is improved. Furthermore, as Cu distributing in the grain boundary increases the amount of liquid phase with a low melting point, the increasing of the liquid phase with a low melting point promotes the migration of W, referred from the EPMA result of FIG. 3, in the present invention, the distribution of W in the grain boundary is very uniform, with a distribution range exceeds the distribution range of Nd-rich phase and totally wraps the whole Nd-rich phase, which may be regarded as an evidence that W plays the pinning effect and blocks the growth of crystal.

Furthermore, in the conventional manner, a plurality of metallic boride phases with a high melting point may appear due to abundant addition of high melting point metal element comprising Zr, Hf, Mo, V, W, and Nb etc, the boride phases have a very high hardness, which are very hard, and may sharply deteriorate the machining property. However, as the content of W of the present invention is very minor and high melting point metallic boride phases hardly appear, even a minor existence hardly deteriorates machining.

What needs to be explained is that in the present usually adopted preparing rare earth method, a graphite crucible electrolyzer is adopted, a cylindrical graphite crucible is used as the positive pole, a tungsten (W) stick is disposed on the axis of the crucible and used as the negative pole, and the bottom of a tungsten crucible is adopted for collecting rare earth metal. In the manufacturing process of the rare earth element (such as Nd) as stated, a small amount of W is inevitably mixed in. Of course, molybdenum (Mo) and other high melting point metal may also be adopted as the negative pole, simultaneously, a molybdenum crucible is adopted for collecting rare earth metal to obtain the rare earth element completely without W.

In the present invention, W may also be impurities from raw material (such as pure Fe, rare earth metal and B etc) and so on, the selection of raw material adopted by the present invention is depended on the content of the impurities of the raw material; of course, a raw material (such as pure Fe, rare earth metal, and B etc) with W content below the detecting limit of the existing device (may be regarded as without W) may also be selected, and adopts a manner by adding the content of the W metallic raw material as stated by the present invention. In short, as long as the raw material comprises a necessary amount of W and regardless the resource of W. The content of W element of Nd metal from different factories and different producing areas are exemplified in TABLE 1.

TABLE 1

Content of W element of Nd metal from different factories and different producing areas

| raw material of metal W | purity | Concentration of W(ppm) |
|---|---|---|
| A | 2N5 | below the detecting limit |
| B | 2N5 | 1 |
| C | 2N5 | 11 |
| D | 2N5 | 28 |
| E | 2N5 | 89 |
| F | 2N5 | 150 |
| G | 2N5 | 251 |

The meaning represented by 2N5 of TABLE 1 is 99.5%.

What needs to be explained is that in the present invention, the content range of 12 at %~15.2 at % of R, 5 at %~8 at % of B, the balance 0 at %~20 at % Co and Fe etc is the conventional selection of the present invention, therefore, the content range of R, B, Fe and Co of the embodiments are not experimented and verified.

Furthermore, a low-oxygen environment is needed for accomplishing all of the manufacturing processes of the magnet of the present invention, the content of 0 is controlled at 0.1 at %~1.0 at %, such that the asserted effect of the present invention may be obtained. Generally speaking, a rare earth magnet with a higher content of oxygen (above 2500 ppm) is capable of reducing the formation of AGG, however, although a rare earth magnet with a lower content of oxygen has a favorable magnetic property, the formation of AGG is easily; in comparison, the present invention only comprises an extremely minor amount of W and a small amount of Cu, and simultaneously capable of acquiring the effect of reducing AGG in the low-oxygen magnet.

What needs to be explained is that, because the low-oxygen manufacturing process of the magnet is a conventional technique, and the low-oxygen manufacturing manner is adopted in all of the embodiments of the present invention, no more relevant detailed description here.

In a preferred embodiment, the content of X is below 2.0 at %.

In a preferred embodiment, the magnet is manufactured by the following steps: a process of producing an alloy for the sintered magnet by casting a molten raw material with the composition of the sintered magnet at a quenching speed of $10^{2\circ}$ C./s~$10^{4\circ}$ C./s; processes of producing a fine powder by firstly coarsely crushing and secondly finely crushing the alloy for the sintered magnet; and obtaining a compact by magnetic field compacting method, further sintering the compact in vacuum or inert gas at a temperature of 900° C.~1100° C. to obtain the sintered magnet. It is a conventional technique of the industry for adopting the sintering temperature of 900° C.~1100° C. therefore the temperature range of the sintering of the embodiments is not experimented and verified.

By adopting the above stated manners, the dispersion degree of W in the grain boundary is increased, the squareness exceeds 95%, and the heat-resistance property of the magnet is improved.

Research shows that the methods of increasing the dispersion degree of W are shown as follows:

1) Adjusting the cooling speed of the alloy for sintered magnet made by the molten liquid comprising the components of sintered magnet, the quicker the cooling speed, the better the dispersion degree of W;

2) Controlling the viscosity of the molten liquid comprising the components of sintered magnet, the smaller the viscosity, the better the dispersion degree of W;

3) Adjusting the cooling speed after sintering, the quicker the cooling speed, the better the dispersion degree of W, because the lattice defect is reduced.

In the present invention, the dispersion degree of W is improved mainly by controlling the cooling speed of the molten liquid.

In a preferred embodiment, the content of B of the sintered magnet is preferably 5 at %~6.5 at %. Boride compound phase is formed because excessive amount of B is very easily reacts with W, those boride compound phases have a very high hardness, which are very hard and sharply deteriorates the machining property, meanwhile, as the boride compound phase ($WB_2$ phase) with a large size is formed, the uniform pinning effect of W in the crystal grain boundary is affected, therefore, the formation of boride compound phase is reduced and the uniform pinning effect of W is sufficiently performed by properly reducing the content of B. By the analysis of FE-EPMA, when the content of B is above 6.5 at %, a great amount of $R(T,B)_2$ comprising B may be generated in the crystal grain boundary, and when the content of B is 5.0 at %~6.5 at %, $R_6T_{13}X$ (X=Al, Cu, Ga etc) type phase comprising W is generated, the generation of this phase optimizes the coercivity and squareness and possess a weak magnetism, W is beneficial to the generation of $R_6T_{13}X$ type phase and improves the stability.

In a preferred embodiment, the content of Al of the sintered magnet is preferably 0.8 at %~2.0 at %, by the analysis of FE-EPMA, when the content of Al is 0.8 at %~2.0 at %, $R_6T_{13}X$ (X=Al, Cu, Ga etc) type phase comprising W is generated, the generation of this phase optimizes the coercivity and squareness and possess a weak magnetism, W is beneficial to the generation of $R_6T_{13}X$ type phase and improves the stability.

In a preferred embodiment, the inevitable impurities of the present invention further comprises a few amount of C, N, S, P and other impurities in the raw material or inevitably mixed into the manufacturing process, therefore, during the manufacturing process of the sintered magnet of the present invention, the content of C is preferably controlled below 1 at %, below 0.4 at % is more preferred, while the content of N is controlled below 0.5 at %, the content of S is controlled below 0.1 at %, the content of P is controlled below 0.1 at %.

In a preferred embodiment, the coarsely crushing comprises the process of hydrogen decrepitating the alloy for the sintered magnet to obtain a coarse powder; the finely crushing comprises the process of jet milling the coarse powder, further comprises a process of removing at least one part of the powder with a particle size of smaller than 1.0 μm after the finely crushing, so that the powder which has a particle size smaller than 1.0 μm is reduced to below 10% of total powder by volume.

In a preferred embodiment, further comprising a process of treating the sintered magnet by RH grain boundary diffusion. The grain boundary diffusion is generally performed at the temperature of 700° C.~1050° C., the temperature range is the conventional selection of the industry, and therefore, the stated temperature range of the embodiments is not experimented and verified.

During the grain boundary diffusion to the sintered magnet, a minor amount of W may generate a very minor amount of W crystal, and may not hinder the diffusion of RH, therefore the speed of diffusion is very fast. Furthermore, Nd-rich phase with a low melting point is formed as the comprising of appropriate amount of Cu, which may further performs the effect of promoting diffusion. Therefore, the magnet of the present invention is capable of obtaining an extremely high property and an enormous leap by the RH grain boundary diffusion.

In a preferred embodiment, the RH being selected from at least one of Dy or Tb.

In a preferred embodiment, further comprising a step of aging treatment: treating the sintered magnet at a temperature of 400° C.~650° C.

In a preferred embodiment, further comprising a two-step aging treatment: first-order heat treating the sintered magnet at 800° C.~950° C. for 1 h~2 h, then second-order heat treating the sintered magnet at 450° C.~660° C. for 1 h~4 h.

In a preferred embodiment, the content of O of the sintered magnet is 0.1 at %~0.5 at %. In the range, the proportioning of O, W and Cu achieves the best proportioning, the heat-resistance of the sintered magnet is high, the magnet is stable under dynamic working condition, the content of oxygen is low and Hcj is increased when no AGG is existed.

In a preferred embodiment, the content of Ga of the sintered magnet is 0.05 at %~0.8 at %.

Another objective of the present invention is to disclose an quenching alloy for W-containing R—Fe—B—Cu serial sintered magnet.

A quenching alloy for W-containing R—Fe—B—Cu serial sintered magnet, wherein the alloy comprises a W-rich area with a W content above 0.004 at % and below 0.26 at %, the W-rich area is distributed with a uniform dispersion in the crystal grain boundary, and accounting for at least 50 vol % of the crystal grain boundary.

Compared to the conventional technique, the present invention has the following advantages:

1) Based on the three magnet technique for mass production of the background of the invention which improves the property of the magnet, the present invention devotes a research in relation with microelement, and improves SQ, Hcj, Br and (BH)max of the magnet by depressing AGG during sintering, results show that, a minor amount of W pinning crystal substance uniformly pins the migration of the grain boundary in the crystal grain boundary, which effectively prevents the generation of abnormal grain growth (AGG), and may achieve a significant improving effect.

2) The content of W of the present invention is very minor and uniformly dispersed, and high melting point metallic boride phases hardly appear, even a minor existence hardly deteriorate machining 3) The present invention comprises a minor amount of W (non-magnetic element), that is a content below 0.03 at %, the dilution effect is lower, and hardly contains amorphous phases and isotropic quenching phases in the quenching magnet alloy, tested with FE-EPMA, most of the minor amount of W is existed in the crystal grain boundary, therefore a minor amount of W of the present invention may not reduce Br and (BH)max absolutely, while increasing Br and (BH)max instead.

4) The component of the present invention comprises a minor amount of Cu and W, so that the intermetallic compound with high melting point [such as $WB_2$ phase (melting point 2365° C.) etc] may not be generated in the grain boundary, while many eutectic alloys such as RCu (melting point 662° C.), $RCu_2$ (melting point 840° C.) and Nd—Cu (melting point 492° C.) etc are generated, as a result, almost all of the phases in the crystal grain boundary except W phase are melted under the grain boundary diffusion temperature, the efficiency of the grain boundary diffusion is favorable, the squareness and coercivity have been improved to an unparalleled extent, especially the squareness reaches above 99%, thus obtaining a high performance magnet with a fine heat-resistance property. The $WB_2$ phase comprises WFeB alloy, WFe alloy, WB alloy and so on.

5) A minor amount of W is capable of promoting the formation of $R_6T_{13}X$-type phase (X=Al, Cu and Ga etc), the generation of this phase improves the coercivity and squareness and is weakly magnetic.

DETAILED DESCRIPTION OF PREFERRED EMBODIMENTS

Figure 1:
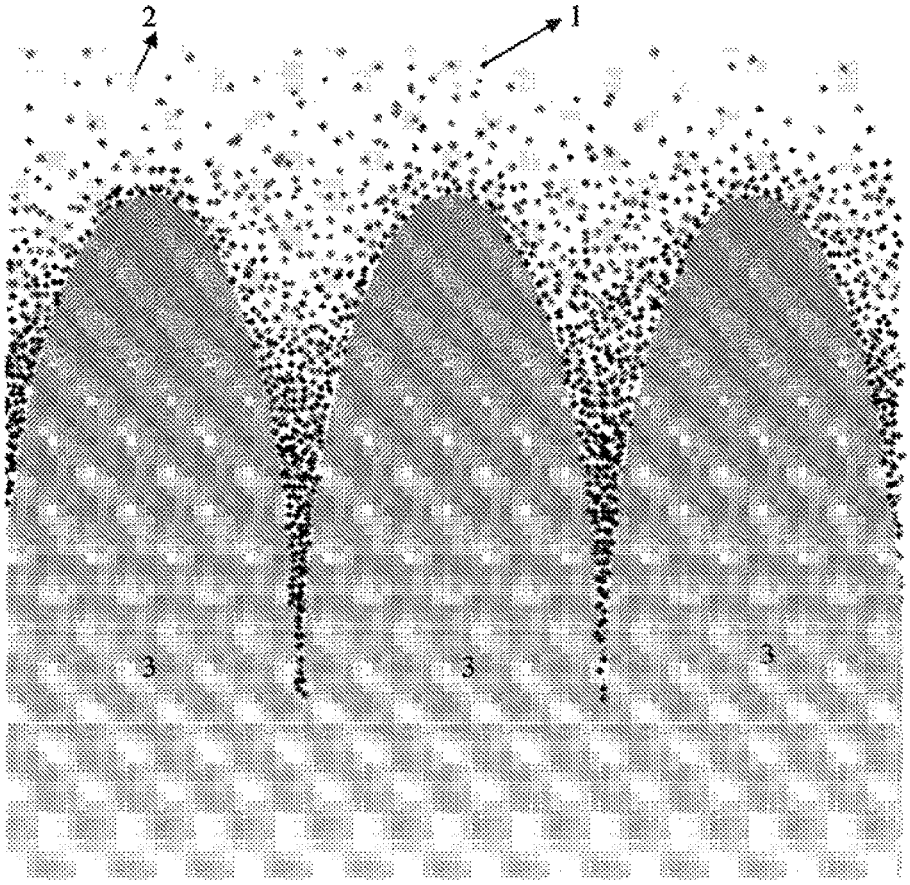
FIG. 1 schematically illustrates the principle of the pinning effect of W to the grain boundary migration.

The present invention will be further described with the embodiments.

The definitions of BHH, magnetic property evaluation process and AGG determination are as follows:

BHH is the sum of (BH) max and Hcj, which is one of the evaluation standards of the comprehensive property of the magnet.

Magnetic property evaluation process: testing the sintered magnet by NIM-10000H type nondestructive testing system for BH large rare earth permanent magnet from China Jiliang University.

AGG determination: polishing the sintered magnet in a direction perpendicular to its alignment direction, the average amount of AGG comprised in each 1 $cm^2$ are determined, the AGG stated by the present invention has a grain size exceeding 40 μm.

The detecting limit detected with FE-EPMA stated by each embodiment is around 100 ppm; the detecting conditions are as follows:

| element | analyzing crystal | CH spectrometer channel | analysis line | accelerating voltage | probe current | standard sample |
|---|---|---|---|---|---|---|
| Cu | LiFH | CH-3 | Lα | 20 kv | 50 nA | Cu simple substance |
| Nd | LiFH | CH-3 | Lα | 20 kv | 50 nA | $NdP_5O_{14}$ |
| W | LiFH | CH-4 | Lα | 20 kv | 50 nA | W simple substance |

The highest resolution of FE-EPMA reaches 3 nm, the resolution may also reach 50 nm under the above stated detecting conditions.

Embodiment I

Raw material preparing process: preparing Nd and Dy respectively with 99.5% purity, industrial Fe—B, industrial pure Fe, Co with 99.9% purity, Cu and Al respectively with 99.5% purity, and W with 99.999% purity; being counted in atomic percent at %.

In order to precisely control the using proportioning of W, the content of W of the Nd, Dy, Fe, B, Al, Cu and Co used in the embodiment is under the detecting limit of the existing devices, the resource of W is from an extra added W metal.

The contents of each element are shown in TABLE 2:

TABLE 2

| Proportioning of each element (at %) | | | | | | | | |
|---|---|---|---|---|---|---|---|---|
| No. | Nd | Dy | B | W | Al | Cu | Co | Fe |
| 1 | 13.5 | 0.5 | 6 | $3 * 10^{-4}$ | 1 | 0.1 | 1.8 | remainder |
| 2 | 13.5 | 0.5 | 6 | $5 * 10^{-4}$ | 1 | 0.1 | 1.8 | remainder |
| 3 | 13.5 | 0.5 | 6 | 0.002 | 1 | 0.1 | 1.8 | remainder |
| 4 | 13.5 | 0.5 | 6 | 0.01 | 1 | 0.1 | 1.8 | remainder |
| 5 | 13.5 | 0.5 | 6 | 0.02 | 1 | 0.1 | 1.8 | remainder |
| 6 | 13.5 | 0.5 | 6 | 0.03 | 1 | 0.1 | 1.8 | remainder |
| 7 | 13.5 | 0.5 | 6 | 0.05 | 1 | 0.1 | 1.8 | remainder |

Preparing 100 Kg raw material of each sequence number group by respective weighing in accordance with TABLE 2.

Melting process: placing the prepared raw material into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace so that the Ar pressure would reach 50000 Pa, then obtaining a quenching alloy by being casted by single roller quenching method at a quenching speed of $10^{2}$° C./s~$10^{4}$° C./s, thermal preservating the quenching alloy at 600° C. for 60 minutes, and then being cooled to room temperature.

Figure 2:
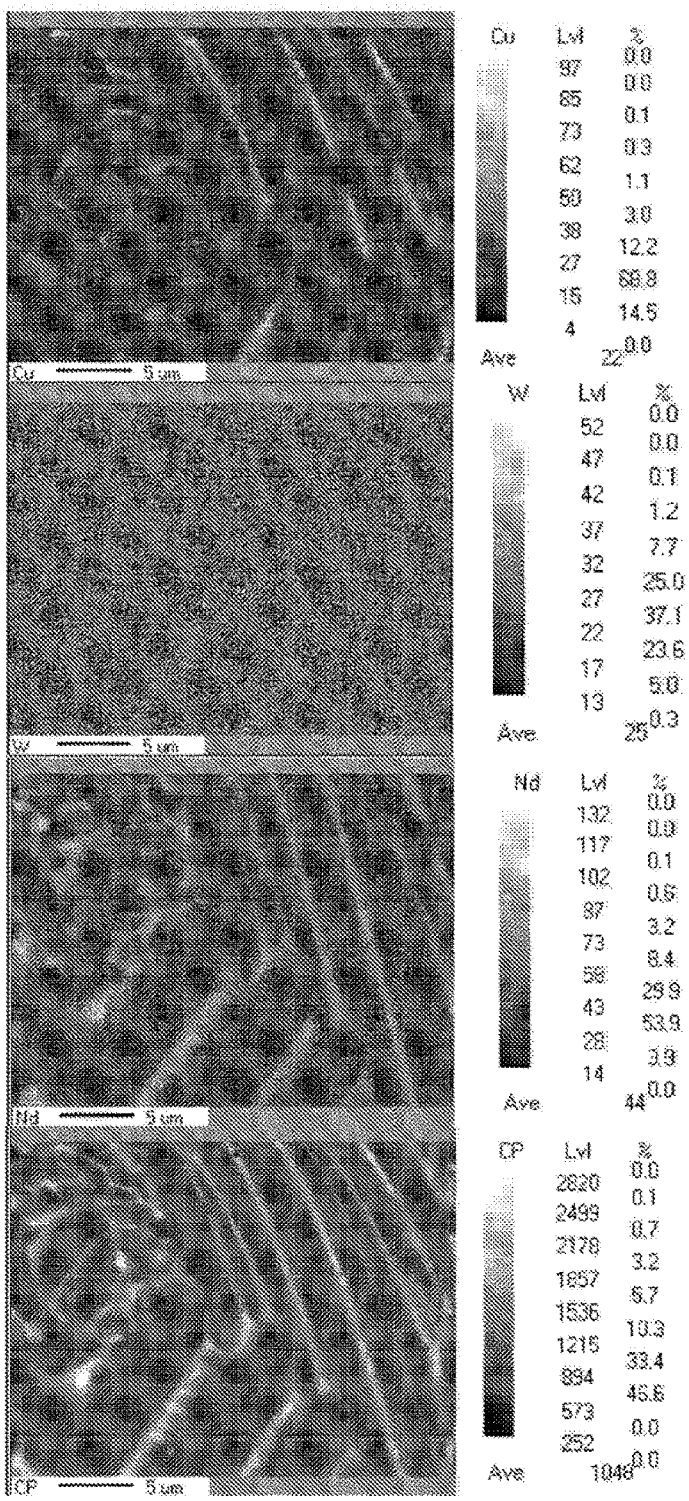
FIG. 2 illustrates an EPMA detecting result of a quenching alloy sheet of embodiment 3 of embodiment I.

Detecting the compound of Cu, Nd and W of the quenching alloy manufactured according to embodiment 3 with FE-EPMA (Field emission-electron probe micro-analyzer) [Japanese electronic kabushiki kaisha (JEOL), 8530F], the results are shown in FIG. 2, which may be observed that, W is distributed in R-rich phase with a high dispersity.

Detecting the quenching alloy sheets with FE-EPMA, the W-rich region is distributed in the crystal grain boundary with a uniform dispersity, and occupies at least 50 vol % of the alloy crystal grain boundary, wherein, the W-rich region means a region with the content of W above 0.004 at % and below 0.26 at %.

Hydrogen decrepitation process: at room temperature, vacuum pumping the hydrogen decrepitation furnace placed with the alloy, then filling hydrogen with 99.5% purity into the furnace until the pressure reaches 0.1 MPa, after the alloy being placed for 2 hours, vacuum pumping and heating at the same time, performing the vacuum pumping at 500° C. for 2 hours, then being cooled, and the powder treated after hydrogen decrepitation process being taken out.

Fine crushing process: performing jet milling to a sample in the crushing room under a pressure of 0.4 MPa and in the atmosphere with oxidizing gas below 100 ppm, then obtaining an average particle size of 4.5 μm of fine powder. The oxidizing gas means oxygen or water.

Adopting a classifier to classify the partial fine powder (occupies 30% of the total weight of the fine powder) treated after the fine crushing process, removing the powder particle with a particle size smaller than 1.0 μm, then mixing the classified fine powder and the remaining un-classified fine powder. The powder with a particle size smaller than 1.0 μm is reduced to below 10% of total powder by volume in the mixed fine powder.

Methyl caprylate is added into the powder treated after jet milling, the additive amount is 0.2% of the mixed powder by weight, further the mixture is comprehensively mixed by a V-type mixer.

Compacting process under a magnetic field: a transversed type magnetic field molder being used, compacting the powder added with methyl caprylate in once to form a cube with sides of 25 mm in an orientation field of 1.8 T and under a compacting pressure of 0.4 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact to the sintering furnace, firstly sintering in a vacuum of $10^{-3}$ Pa and respectively maintained for 2 hours at 200° C. and for 2 hours at 800° C., then sintering for 2 hours at 1030° C., after that filling Ar gas into the sintering furnace so that the Ar pressure would reach 0.1 MPa, then being cooled to room temperature.

Heat treatment process: annealing the sintered magnet for 1 hour at 460° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Directly testing the sintered magnet manufactured according to the embodiments 1~7, and the magnetic property is evaluated. The evaluation results of the magnets of the embodiments are shown in TABLE 3 and TABLE 4.

TABLE 3

Evaluation of the microstructure of the embodiments

| No. | Average amount of W in the grain boundary phase (at %) | Ratio of W-rich phase in the magnet (vol %) | $WB_2$ phase | amorphous phase | isotropic phase | number of AGG |
|---|---|---|---|---|---|---|
| 1 | 0.002 | 4.8 | no | no | no | 23 |
| 2 | 0.004 | 5.0 | no | no | no | 2 |
| 3 | 0.018 | 7.4 | no | no | no | 1 |
| 4 | 0.090 | 9.5 | no | no | no | 0 |
| 5 | 0.168 | 9.8 | no | no | no | 0 |
| 6 | 0.255 | 11.0 | no | no | no | 0 |
| 7 | 0.440 | 13.2 | yes | yes | yes | 0 |

The amorphous phase and isotropic phase of TABLE 3 investigate the amorphous phase and isotropic phase of the alloy.

The W-rich phase of TABLE 3 is a region with W content above 0.004 at % and below 0.26 at %.

TABLE 4

Magnetic property evaluation of the embodiments

| No. | Br (kGs) | Hcj (kOe) | SQ (%) | (BH) max (MGOe) | BHH |
|---|---|---|---|---|---|
| 1 | 12.84 | 9.43 | 78.43 | 36.34 | 45.77 |
| 2 | 14.22 | 16.71 | 96.74 | 47.23 | 63.94 |
| 3 | 14.16 | 17.23 | 98.96 | 46.78 | 64.01 |
| 4 | 14.12 | 17.65 | 99.93 | 46.57 | 64.22 |
| 5 | 14.06 | 17.79 | 99.95 | 46.76 | 64.55 |
| 6 | 14.01 | 17.56 | 98.84 | 46.14 | 63.7 |
| 7 | 13.16 | 13.28 | 94.56 | 39.86 | 53.14 |

Through the manufacturing process, special attention is paid to the control of the contents of O, C and N, and the contents of the three elements O, C, and N are respectively controlled below 0.1~0.5 at %, 0.3 at % and 0.1 at %.

We may draw a conclusion that, in the present invention, when the content of W in the magnet is below 0.0005 at %, the pinning effect is hardly effective as the content of W is too low, and the existing of Cu in the raw material may easily causes AGG, and reduces SQ and Hcj, oppositely, when the content of W exceeds 0.03 at %, a part of $WB_2$ phase may be generated, which reduces the squareness and magnetic property, furthermore, the amorphous phase and the isotropic phase may be generated in the obtained quenching alloy and which sharply reduces the magnetic property.

Figure 3:
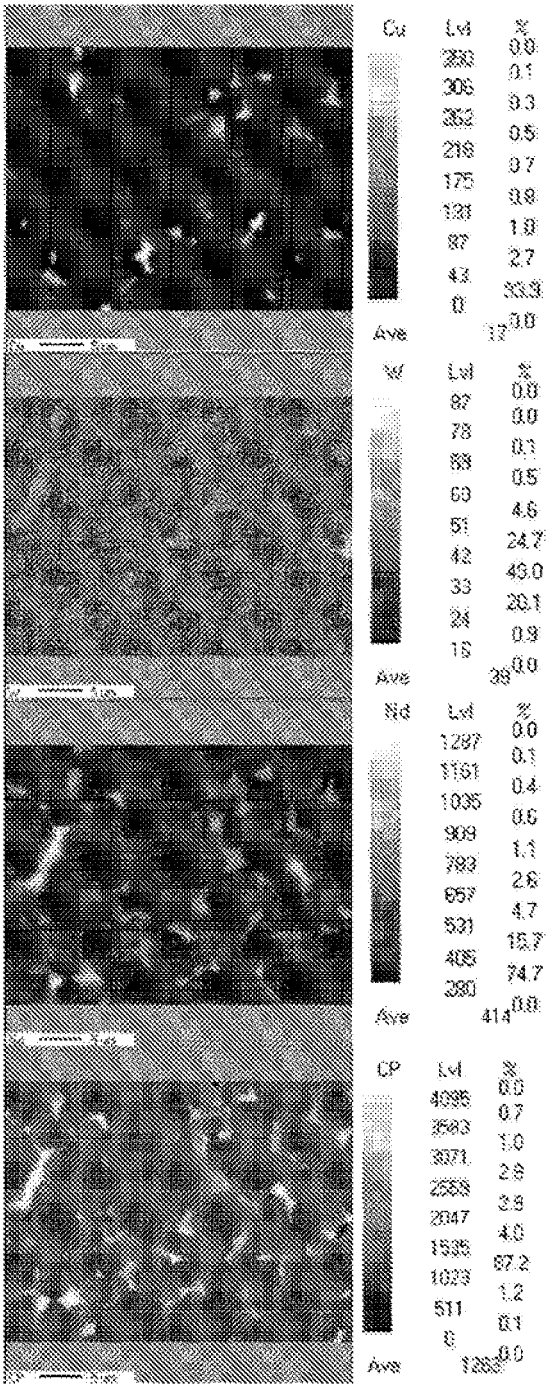
FIG. 3 illustrates an EPMA detecting result of a sintered magnet of embodiment 3 of embodiment I.

Detecting the compound of Cu, Nd and W of the quenching alloy manufactured according to embodiment 3 with FE-EPMA (Field emission-electron probe micro-analyzer) [Japanese electronic kabushiki kaisha (JEOL), 8530F], the results are shown in FIG. 3, which may be observed that, W is distributed with a high dispersity and performs a uniform pinning effect to the migration of the grain boundary, and the formation of AGG is prevented.

Similarly, detecting embodiment 2, 4, 5 and 6 with FE-EPMA, which also may be observed that, W performs a uniform pinning effect to the migration of the grain boundary with a high dispersity, and the formation of AGG is prevented.

Embodiment II

Raw material preparing process: preparing Nd, Pr and Tb respectively with 99.9% purity, B with 99.9% purity, Fe with 99.9% purity, W with 99.999% purity, and Cu and Al respectively with 99.5% purity; being counted in atomic percent at %.

In order to precisely control the using proportioning of W, the content of W of the Nd, Pr, Tb, Fe, B, Al and Cu used in the embodiment is under the detecting limit of the existing devices, the resource of W is from an extra added W metal.

The contents of each element are shown in TABLE 5:

TABLE 5

Proportioning of each element (at %)

| No. | Nd | Pr | Tb | B | W | Al | Cu | Fe |
|---|---|---|---|---|---|---|---|---|
| 1 | 9.7 | 3 | 0.3 | 5 | 0.01 | 0.4 | 0.03 | remainder |
| 2 | 9.7 | 3 | 0.3 | 5 | 0.01 | 0.4 | 0.05 | remainder |
| 3 | 9.7 | 3 | 0.3 | 5 | 0.01 | 0.4 | 0.1 | remainder |
| 4 | 9.7 | 3 | 0.3 | 5 | 0.01 | 0.4 | 0.3 | remainder |
| 5 | 9.7 | 3 | 0.3 | 5 | 0.01 | 0.4 | 0.5 | remainder |
| 6 | 9.7 | 3 | 0.3 | 5 | 0.01 | 0.4 | 0.8 | remainder |
| 7 | 9.7 | 3 | 0.3 | 5 | 0.01 | 0.4 | 1.2 | remainder |
| 8 | 9.7 | 3 | 0.3 | 5 | 0.01 | 0.4 | 1.5 | remainder |

Preparing 100 Kg raw material of each sequence number group by respective weighing in accordance with TABLE 5.

Melting process: placing the prepared raw material into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace so that the Ar pressure would reach 30000 Pa, then obtaining a quenching alloy by being casted by single roller quenching method at a quenching speed of $10^{2}$° C./s~$10^{4}$° C./s, thermal preservation treating the quenching alloy at 600° C. for 60 minutes, and then being cooled to room temperature.

Detecting the quenching alloy sheets of embodiments 2~7 with FE-EPMA, the W-rich region is distributed in the crystal grain boundary with a uniform dispersity, and occupies at least 50 vol % of the alloy crystal grain boundary, wherein, the W-rich region means a region with the content of W above 0.004 at % and below 0.26 at %.

Hydrogen decrepitation process: at room temperature, vacuum pumping the hydrogen decrepitation furnace placed with the alloy, then filling hydrogen with 99.5% purity into the furnace until the pressure reach 0.1 MPa, after the alloy being placed for 125 minutes, vacuum pumping and heating at the same time, performing the vacuum pumping at 500° C. for 2 hours, then being cooled, and the powder treated after hydrogen decrepitation process being taken out.

Fine crushing process: performing jet milling to a sample in the crushing room under a pressure of 0.41 MPa and in the atmosphere of oxidizing gas below 100 ppm, then obtaining an average particle size of 4.30 μm of fine powder. The oxidizing gas means oxygen or water.

Methyl caprylate is added into the powder treated after jet milling, the additive amount is 0.25% of the mixed powder by weight, further the mixture is comprehensively mixed by a V-type mixer.

Compacting process under a magnetic field: a transversed type magnetic field molder being used, compacting the powder added with methyl caprylate in once to form a cube with sides of 25 mm in an orientation field of 1.8 T and under a compacting pressure of 0.3 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.0 ton/cm$^2$.

Sintering process: moving each of the compact to the sintering furnace, firstly sintering in a vacuum of $10^{-3}$ Pa and respectively maintained for 3 hours at 200° C. and for 3 hours at 800° C., then sintering for 2 hours at 1020° C., after that filling Ar gas into the sintering furnace so that the Ar pressure would reach 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Directly testing the sintered magnet manufactured according to the embodiments 1~8, and the magnetic property is evaluated. The evaluation results of the magnets of the embodiments are shown in TABLE 6 and TABLE 7.

TABLE 6

Evaluation of the microstructure of the embodiments

| No. | Average amount of W in the grain boundary (at %) | Ratio of W-rich phase in the magnet (vol %) | $WB_2$ phase | amorphous phase | isotropic phase | number of AGG |
|---|---|---|---|---|---|---|
| 1 | 0.090 | 10.0 | no | yes | yes | 14 |
| 2 | 0.088 | 10.1 | no | no | no | 2 |

TABLE 6-continued

Evaluation of the microstructure of the embodiments

| No. | Average amount of W in the grain boundary (at %) | Ratio of W-rich phase in the magnet (vol %) | $WB_2$ phase | amorphous phase | isotropic phase | number of AGG |
|---|---|---|---|---|---|---|
| 3 | 0.092 | 10.0 | no | no | no | 1 |
| 4 | 0.092 | 9.98 | no | no | no | 0 |
| 5 | 0.091 | 9.95 | no | no | no | 0 |
| 6 | 0.093 | 10.0 | no | no | no | 0 |
| 7 | 0.092 | 10.2 | no | no | no | 1 |
| 8 | 0.090 | 10.0 | no | yes | yes | 5 |

The amorphous phase and isotropic phase of TABLE 6 investigate the amorphous phase and isotropic phase of the alloy.

The W-rich phase of TABLE 6 is a region with W content above 0.004 at % and below 0.26 at %.

TABLE 7

Magnetic property evaluation of the embodiments

| No. | Br (kGs) | Hcj (kOe) | SQ (%) | (BH) max (MGOe) | BHH |
|---|---|---|---|---|---|
| 1 | 14.14 | 14.34 | 89.56 | 45.32 | 59.66 |
| 2 | 14.34 | 18.67 | 98.02 | 48.26 | 66.93 |
| 3 | 14.23 | 19.23 | 98.45 | 47.74 | 66.97 |
| 4 | 14.17 | 20.03 | 99.56 | 47.28 | 67.31 |
| 5 | 14.06 | 20.38 | 99.67 | 46.76 | 67.14 |
| 6 | 14.02 | 20.68 | 99.78 | 46.46 | 67.14 |
| 7 | 14.01 | 20.23 | 99.71 | 46.32 | 66.55 |
| 8 | 13.59 | 16.76 | 94.23 | 43.12 | 59.88 |

Through the manufacturing process, special attention is paid to the control of the contents of O, C and N, and the contents of the three elements O, C, and N are respectively controlled below 0.1~0.5 at %, 0.4 at % and 0.2 at %.

We may draw a conclusion that, when the content of Cu is below 0.05 at %, the dependency of the heat treatment temperature of the coercivity may be increased, and the magnetic property is reduced, oppositely, when the content of Cu exceeds 1.2 at %, the generating amount of AGG may be increased as the consequence of low melting point phenomenon of Cu, even the pinning effect of W may hardly prevent the mass generation of AGG, indicating that an appropriate range of Cu and W is existed in the magnet with low content of oxygen.

Similarly, detecting embodiment 2~7 with FE-EPMA [Japanese electronic kabushiki kaisha (JEOL), 8530F], which also may be observed that, W performs a uniform pinning effect to the migration of the grain boundary with a high dispersity, and the formation of AGG is prevented.

Embodiment III

Raw material preparing process: preparing Nd with 99.5% purity, industrial Fe—B, industrial pure Fe, Co with 99.9% purity, Cu with 99.5% purity and W with 99.999% purity; being counted in atomic percent at %.

In order to precisely control the using proportioning of W, the content of W of the Nd, Fe, B, Cu and Co used in the embodiment is under the detecting limit of the existing devices, the resource of W is from an extra added W metal.

The contents of each element are shown in TABLE 8:

TABLE 8

| Proportioning of each element (at %) | | | | | |
|---|---|---|---|---|---|
| Nd | B | W | Cu | Co | Fe |
| 15 | 6 | 0.02 | 0.2 | 0.3 | remainder |

Preparing 700 Kg raw material by weighing in accordance with TABLE 8.

Melting process: placing the prepared raw material into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace so that the Ar pressure would reach 50000 Pa, then obtaining a quenching alloy by being casted by single roller quenching method at a quenching speed of $10^{2}$° C./s~$10^{4}$° C./s, thermal preservation treating the quenching alloy at 600° C. for 60 minutes, and then being cooled to room temperature.

Detecting the quenching alloy sheets of embodiments 2, 3, 4, 5 and 6 with FE-EPMA, the W-rich region is distributed in the crystal grain boundary with a uniform dispersity, and occupies at least 50 vol % of the alloy crystal grain boundary, wherein, the W-rich region means a region with the content of W above 0.004 at % and below 0.26 at %.

Hydrogen decrepitation process: at room temperature, vacuum pumping the hydrogen decrepitation furnace placed with the alloy, then filling hydrogen with 99.5% purity into the furnace until the pressure reach 0.1 MPa, after the alloy being placed for 97 minutes, vacuum pumping and heating at the same time, performing the vacuum pumping at 500° C. for 2 hours, then being cooled, and the powder treated after hydrogen decrepitation process being taken out.

Fine crushing process: dividing the powder treated after the Hydrogen decrepitation process into 7 parts, performing jet milling to each part of the powder in the crushing room under a pressure of 0.42 MPa and in the atmosphere of 10~3000 ppm of oxidizing gas, then obtaining an average particle size of 4.51 μm of fine powder. The oxidizing gas means oxygen or water.

Methyl caprylate is added into the powder treated after jet milling, the additive amount is 0.1% of the mixed powder by weight, further the mixture is comprehensively mixed by a V-type mixer.

Compacting process under a magnetic field: a transversed type magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact to the sintering furnace, firstly sintering in a vacuum of $10^{-3}$ Pa and respectively maintained for 2 hours at 200° C. and for 2 hours at 700° C., then sintering for 2 hours at 1020° C., after that filling Ar gas into the sintering furnace so that the Ar pressure would reach 0.1 MPa, then being cooled to room temperature.

Heat treatment process: in the atmosphere of high purity Ar gas, performing a first order annealing for the sintered magnet for 1 hour at 900° C., then performing a second order annealing for 1 hour at 500° C., being cooled to room temperature and taken out.

Machining process: machining the sintered magnet after heat treatment as a magnet with ϕ15 mm diameter and 5 mm thickness, the 5 mm direction being the orientation direction of the magnetic field.

Thermal demagnetization determination: firstly placing the sintered magnet in an environment of 150° C. and thermal preservation for 30 min, then cooling the sintered magnet to room temperature by nature, testing the magnetic flux of the sintered magnet, comparing the testing result with the testing data before heating, and calculating the magnetic flux retention rates before heating and after heating.

Directly testing the sintered magnet manufactured according to the embodiments 1~7, and the magnetic property is evaluated. The evaluation results of the magnets of the embodiments are shown in TABLE 9 and TABLE 10.

TABLE 9

| Evaluation of the microstructure of the embodiments | | | | | | | |
|---|---|---|---|---|---|---|---|
| No. | content of $O_2$ of the gas of fine crushing process(ppm) | content of $H_2O$ of the gas of fine crushing process (ppm) | average amount of W in the grain boundary (at %) | ratio of W-rich phase of the magnet (vol %) | $WB_2$ phase | Number of AGG | content of O in the magnet (at %) |
| 1 | 5 | 5 | 0.188 | 10.0 | no | 9 | 0.08 |
| 2 | 28 | 22 | 0.180 | 10.1 | no | 1 | 0.1 |
| 3 | 52 | 42 | 0.185 | 10.1 | no | 0 | 0.3 |
| 4 | 261 | 86 | 0.190 | 10.2 | no | 0 | 0.5 |
| 5 | 350 | 150 | 0.185 | 10.0 | no | 0 | 0.8 |
| 6 | 1000 | 250 | 0.186 | 10.0 | no | 1 | 1 |
| 7 | 2000 | 1000 | 0.180 | 10.1 | no | 5 | 1.2 |

The W-rich phase of TABLE 9 is a region above 0.004 at % and below 0.26 at %.

TABLE 10

Magnetic property evaluation of the embodiments

| No. | Br (kGs) | Hcj (kOe) | SQ (%) | (BH) max (MGOe) | BHH | magnetic flux retention rate (%) |
|---|---|---|---|---|---|---|
| 1 | 12.37 | 8.52 | 79.5 | 28.56 | 37.08 | 46.8 |
| 2 | 13.24 | 14.8 | 98.1 | 41.26 | 56.06 | 0.8 |
| 3 | 13.25 | 15.1 | 99.67 | 41.43 | 56.53 | 0.9 |
| 4 | 13.27 | 16.4 | 99.78 | 41.67 | 58.07 | 0.9 |
| 5 | 13.31 | 16.8 | 99.85 | 41.87 | 58.67 | 12.7 |
| 6 | 13.24 | 15.8 | 98.25 | 41.23 | 57.03 | 13.8 |
| 7 | 13.04 | 13.5 | 82.45 | 38.45 | 51.95 | 18.3 |

Through the manufacturing process, special attention is paid to the control of the contents of C and N, and the contents of the two elements C and N are respectively controlled below 0.2 at % and 0.25 at %.

We may draw a conclusion that, even an appropriate amount of W and Cu is existed, when the content of O of the magnet is below 0.1 at % and exceeds the limit of W pinning effect, the AGG status may happen easily, and therefore the phenomenon of AGG still happens and which sharply reduces the magnetic property. Oppositely, even an appropriate amount of W and Cu is existed, when the content of O of the magnet exceeds 0.1 at %, consequently, the dispersity of the content of oxygen starts getting worse, and a place with many oxygen and the other place with a few oxygen are generated in the magnet, the generation of AGG is increased as the non-uniform, and which reduces coercivity and squareness.

Similarly, detecting embodiment 2~6 with FE-EPMA [Japanese electronic kabushiki kaisha (JEOL), 8530F], as a detecting result, which also may be observed that, W performs a uniform pinning effect to the migration of the grain boundary with a high dispersity, and the formation of AGG is prevented.

Embodiment IV

Raw material preparing process: preparing Nd and Dy respectively with 99.5% purity, industrial Fe—B, industrial pure Fe, Co with 99.9% purity, Cu and Al respectively with 99.5% purity, and W with 99.999% purity; being counted in atomic percent at %.

In order to precisely control the using proportioning of W, the content of W of the Nd, Dy, B, Al, Cu, Co and Fe used in the embodiment is under the detecting limit of the existing devices, the resource of W is from an extra added W metal.

The contents are shown in TABLE 11:

TABLE 11

Proportioning of each element (at %)

| No. | Nd | Dy | B | W | Al | Cu | Co | Fe |
|---|---|---|---|---|---|---|---|---|
| 1 | 13.5 | 0.5 | 5 | 0.005 | 1 | 0.4 | 1.8 | remainder |
| 2 | 13.5 | 0.5 | 5.5 | 0.005 | 1 | 0.4 | 1.8 | remainder |
| 3 | 13.5 | 0.5 | 6.0 | 0.005 | 1 | 0.4 | 1.8 | remainder |
| 4 | 13.5 | 0.5 | 6.5 | 0.005 | 1 | 0.4 | 1.8 | remainder |
| 5 | 13.5 | 0.5 | 7.0 | 0.005 | 1 | 0.4 | 1.8 | remainder |
| 6 | 13.5 | 0.5 | 7.5 | 0.005 | 1 | 0.4 | 1.8 | remainder |
| 7 | 13.5 | 0.5 | 8.0 | 0.005 | 1 | 0.4 | 1.8 | remainder |

Preparing 100 Kg raw material of each sequence number group by respective weighing in accordance with TABLE 11.

Melting process: placing the prepared raw material into an aluminum oxide made crucible at a time, performing a vacuum melting in an intermediate frequency vacuum induction melting furnace in $10^{-2}$ Pa vacuum and below 1550° C.

Casting process: after the process of vacuum melting, filling Ar gas into the melting furnace so that the Ar pressure would reach 20000 Pa, then obtaining a quenching alloy by being casted by single roller quenching method at a quenching speed of $10^{2\circ}$ C./s~$10^{4\circ}$ C./s, thermal preservation treating the quenching alloy at 800° C. for 10 minutes, and then being cooled to room temperature.

Detecting the quenching alloy sheets of embodiments 1~7 with FE-EPMA, the W-rich region is distributed in the crystal grain boundary with a uniform dispersity, and occupies at least 50 vol % of the alloy crystal grain boundary, wherein, the W-rich region means a region with the content of W above 0.004 at % and below 0.26 at %.

Hydrogen decrepitation process: at room temperature, vacuum pumping the hydrogen decrepitation furnace placed with the alloy, then filling hydrogen with 99.5% purity into the furnace until the pressure reach 0.1 MPa, after the alloy being placed for 120 minutes, vacuum pumping and heating at the same time, performing the vacuum pumping at 500° C. for 2 hours, then being cooled, and the powder treated after hydrogen decrepitation process being taken out.

Fine crushing process: performing jet milling to a sample in the crushing room under a pressure of 0.6 MPa and in the atmosphere with oxidizing gas below 100 ppm, then obtaining an average particle size of 4.5 μm of fine powder. The oxidizing gas means oxygen or water.

Adopting a classifier to classify the partial fine powder (occupies 30% of the total weight of the fine powder) treated after the fine crushing process, removing the powder particle with a particle size smaller than 1.0 μm, then mixing the classified fine powder and the remaining un-classified fine powder. The powder with a particle size smaller than 1.0 μm is reduced to below 2% of total powder by volume in the mixed fine powder.

Methyl caprylate is added into the powder treated after jet milling, the additive amount is 0.2% of the mixed powder by weight, further the mixture is comprehensively mixed by a V-type mixer.

Compacting process under a magnetic field: a transversed type magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.0 ton/cm$^2$.

Sintering process: moving each of the compact to the sintering furnace, sintering in a vacuum of $10^{-3}$ Pa and respectively maintained for 2 hours at 200° C. and for 2 hours at 800° C., then sintering for 2 hours at 1040° C., after that filling Ar gas into the sintering furnace so that the Ar pressure would reach 0.1 MPa, then being cooled to room temperature.

Heat treatment process: annealing the sintered magnet for 1 hour at 400° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Directly testing the sintered magnet manufactured according to the embodiments 1~7, and the magnetic property is evaluated. The evaluation results of the magnets of the embodiments are shown in TABLE 12 and TABLE 13.

TABLE 12

Evaluation of the microstructure of the embodiments

| No. | Average amount of W in the grain boundary (at %) | Ratio of W-rich phase in the magnet (vol %) | $WB_2$ phase | amorphous phase | isotropic phase | number of AGG |
|---|---|---|---|---|---|---|
| 1 | 0.040 | 9.1 | no | no | no | 0 |
| 2 | 0.045 | 9.2 | no | no | no | 0 |
| 3 | 0.042 | 9.1 | no | no | no | 0 |
| 4 | 0.040 | 9.2 | no | no | no | 0 |
| 5 | 0.045 | 9.0 | no | no | no | 1 |
| 6 | 0.042 | 9.1 | no | no | no | 1 |
| 7 | 0.045 | 9.0 | yes | yes | yes | 2 |

The amorphous phase and isotropic phase of TABLE 12 investigate the amorphous phase and isotropic phase of the alloy.

The W-rich phase of TABLE 12 is a region above 0.004 at % and below 0.26 at %.

TABLE 13

Magnetic property evaluation of the embodiments

| No. | Br (kGs) | Hcj (kOe) | SQ (%) | (BH) max (MGOe) | BHH |
|---|---|---|---|---|---|
| 1 | 13.85 | 17.7 | 99.4 | 44.8 | 62.5 |
| 2 | 13.74 | 17.5 | 99.62 | 44.1 | 61.6 |
| 3 | 13.62 | 18.2 | 99.67 | 43.31 | 61.51 |
| 4 | 13.5 | 17.8 | 99.78 | 42.5 | 60.3 |
| 5 | 13.4 | 16.6 | 99.85 | 41.83 | 58.43 |
| 6 | 13.26 | 16.6 | 98.25 | 41.04 | 57.64 |
| 7 | 13.14 | 16.6 | 98.24 | 40.32 | 56.92 |

Through the manufacturing process, special attention is paid to the control of the contents of O, C and N, and the contents of the three elements O, C, and N are respectively controlled below 0.1~0.5 at %, 0.3 at % and 0.1 at %.

Detecting the embodiments 1~7 with FE-EPMA (Field emission-electron probe micro-analyzer) [Japanese electronic kabushiki kaisha (JEOL), 8530F], which may be observed that, W is distributed with a high dispersity and performs a uniform pinning effect to the migration of the grain boundary, and the formation of AGG is prevented.

Conclusion: by the analysis of FE-EPMA, when the content of B is above 6.5 at %, a great amount of $R(T,B)_2$ comprising B may be generated in the crystal grain boundary, and when the content of B is 5 at %~6.5 at %, $R_6T_{13}X$ (X=Al, Cu etc) type phase comprising W is generated, the generation of this phase optimizes the coercivity and squareness and possess a weak magnetism, W is beneficial to the generation of $R_6T_{13}X$ type phase and improves the stability.

Embodiment V

Raw material preparing process: preparing Nd and Dy respectively with 99.5% purity, industrial Fe—B, industrial pure Fe, Co with 99.9% purity, Cu and Al respectively with 99.5% purity, and W with 99.999% purity; being counted in atomic percent at %.

In order to precisely control the using proportioning of W, the content of W of the Nd, Dy, B, Al, Cu, Co and Fe used in the embodiment is under the detecting limit of the existing devices, the resource of W is from an extra added W metal.

The contents of each element are shown in TABLE 14:

TABLE 14

Proportioning of each element (at %)

| No. | Nd | Dy | B | W | Al | Cu | Co | Fe |
|---|---|---|---|---|---|---|---|---|
| 1 | 13.5 | 0.5 | 6.0 | 0.01 | 0.1 | 0.1 | 1.8 | remainder |
| 2 | 13.5 | 0.5 | 6.0 | 0.01 | 0.2 | 0.1 | 1.8 | remainder |
| 3 | 13.5 | 0.5 | 6.0 | 0.01 | 0.5 | 0.1 | 1.8 | remainder |
| 4 | 13.5 | 0.5 | 6.0 | 0.01 | 0.8 | 0.1 | 1.8 | remainder |
| 5 | 13.5 | 0.5 | 6.0 | 0.01 | 1.0 | 0.1 | 1.8 | remainder |
| 6 | 13.5 | 0.5 | 6.0 | 0.01 | 1.5 | 0.1 | 1.8 | remainder |
| 7 | 13.5 | 0.5 | 6.0 | 0.01 | 2.0 | 0.1 | 1.8 | remainder |

Preparing 100 Kg raw material of each sequence number group by respective weighing in accordance with TABLE 14.

Melting process: placing the prepared raw material into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace so that the Ar pressure would reach 50000 Pa, then obtaining a quenching alloy by being casted by single roller quenching method at a quenching speed of $10^{2°}$ C./s~$10^{4°}$ C./s, thermal preservating the quenching alloy at 700° C. for 5 minutes, and then being cooled to room temperature.

Hydrogen decrepitation process: at room temperature, vacuum pumping the hydrogen decrepitation furnace placed with the alloy, then filling hydrogen with 99.5% purity into the furnace until the pressure reach 0.1 MPa, after the alloy being placed for 120 minutes, vacuum pumping and heating at the same time, performing the vacuum pumping at 600° C. for 2 hours, then being cooled, and the powder treated after hydrogen decrepitation process being taken out.

Fine crushing process: performing jet milling to a sample in the crushing room under a pressure of 0.5 MPa and in the atmosphere of below 100 ppm of oxidizing gas, then obtaining an average particle size of 5.0 μm of fine powder. The oxidizing gas means oxygen or water.

Screening partial fine powder which is treated after the fine crushing process (occupies 30% of the total fine powder by weight), then mixing the screened fine powder and the unscreened fine powder. The powder which has a particle size smaller than 1.0 μm is reduced to below 10% of total powder by volume in the mixed fine powder.

Methyl caprylate is added into the powder treated after jet milling, the additive amount is 0.2% of the mixed powder by weight, further the mixture is comprehensively mixed by a V-type mixer.

Compacting process under a magnetic field: a transversed type magnetic field molder being used, compacting the powder added with methyl caprylate in once to form a cube with sides of 25 mm in an orientation field of 1.8 T and under a compacting pressure of 0.2 ton/$cm^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.0 ton/cm$^2$.

Sintering process: moving each of the compact to the sintering furnace, firstly sintering in a vacuum of $10^{-3}$ Pa and respectively maintained for 2 hours at 200° C. and for 2 hours at 800° C., then sintering for 2 hours at 1060° C., after that filling Ar gas into the sintering furnace so that the Ar pressure would reach 0.1 MPa, then being cooled to room temperature.

Heat treatment process: annealing the sintered magnet for 1 hour at 420° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Directly testing the sintered magnet manufactured according to the embodiments 1~7, and the magnetic property is evaluated. The evaluation results of the magnets of the embodiments are shown in TABLE 15.

TABLE 15

Evaluation of the microstructure of the embodiments

| No. | Average amount of W in the grain boundary phase (at %) | Ratio of W-rich phase in the magnet (vol %) | $WB_2$ phase | amorphous phase | isotropic phase | number of AGG |
|---|---|---|---|---|---|---|
| 1 | 0.091 | 10.1 | no | no | no | 2 |
| 2 | 0.090 | 10.1 | no | no | no | 1 |
| 3 | 0.090 | 10.0 | no | no | no | 0 |
| 4 | 0.090 | 10.0 | no | no | no | 0 |
| 5 | 0.093 | 10.0 | no | no | no | 0 |
| 6 | 0.091 | 10.0 | no | no | no | 1 |
| 7 | 0.095 | 10.0 | yes | yes | yes | 2 |

The amorphous phase and isotropic phase of TABLE 15 investigate the amorphous phase and isotropic phase of the alloy.

The W-rich phase of TABLE 15 is a region above 0.004 at % and below 0.26 at %.

TABLE 16

Magnetic property evaluation of the embodiments

| No. | Br (kGs) | Hcj (kOe) | SQ (%) | (BH) max (MGOe) | BHH |
|---|---|---|---|---|---|
| 1 | 14.02 | 14.2 | 98.2 | 45.67 | 59.87 |
| 2 | 13.91 | 14.7 | 98.1 | 45.17 | 59.87 |
| 3 | 13.79 | 15.4 | 99.67 | 44.37 | 59.77 |
| 4 | 13.67 | 17.4 | 99.78 | 43.63 | 61.03 |
| 5 | 13.6 | 17.9 | 99.85 | 43.15 | 61.05 |
| 6 | 13.41 | 19.2 | 98.25 | 41.89 | 61.09 |
| 7 | 13.2 | 20.4 | 82.45 | 40.7 | 61.1 |

Through the manufacturing process, special attention is paid to the control of the contents of O, C and N, and the contents of the three elements O, C, and N are respectively controlled below 0.1~0.5 at %, 0.3 at % and 0.1 at %.

Detecting the embodiments 1~7 with FE-EPMA (Field emission-electron probe micro-analyzer) [Japanese electronic kabushiki kaisha (JEOL), 8530F], which may be observed that, W is distributed with a high dispersity and performs a uniform pinning effect to the migration of the grain boundary, and the formation of AGG is prevented.

Conclusion: by the analysis of FE-EPMA, when the content of Al is 0.8~2.0 at %, $R_6T_{13}X$ (X=Al, Cu etc) type phase comprising W is generated, the generation of this phase optimizes the coercivity and squareness and possess a weak magnetism, W is beneficial to the generation of $R_6T_{13}X$ type phase and improves the stability.

Embodiment VI

Respectively machining each group of sintered magnet manufactured in accordance with Embodiment I to a magnet with ϕ15 mm diameter and 5 mm thickness, the 5 mm direction being the orientation direction of the magnetic field.

Grain boundary diffusion treatment process: cleaning the magnet machined by each of the sintered body, adopting a raw material prepared by Dy oxide and Tb fluoride in a ratio of 3:1, fully spraying and coating the raw material on the magnet, drying the coated magnet, performing heat diffusion treatment in Ar atmosphere at 850° C. for 24 hours.

Magnetic property evaluation process: testing the sintered magnet with Dy diffusion treatment by NIM-10000H type nondestructive testing system for BH large rare earth permanent magnet from China Jiliang University. The results are shown in TABLE 17:

TABLE 17

Coercivity evaluation of the embodiments

| No. | Hcj (kOe) |
|---|---|
| 1 | 17.20 |
| 2 | 25.22 |
| 3 | 26.63 |
| 4 | 26.52 |
| 5 | 26.32 |
| 6 | 26.20 |
| 7 | 19.02 |

It may be seen from TABLE 17, a minor amount of W of the present invention may generate a very minor amount of W crystal in the crystal grain boundary, and may not hinder the diffusion of RH, therefore the speed of diffusion is very fast. Furthermore, Nd-rich phase with a low melting point is formed as the comprising of appropriate amount of Cu, which may further performs the effect of promoting diffusion. Therefore, the magnet of the present invention is capable of obtaining an extremely high property and an enormous leap by the RH grain boundary diffusion.

Embodiment VII

Raw material preparing process: preparing Nd, Dy and Tb respectively with 99.9% purity, B with 99.9% purity, Fe with 99.9% purity, and Cu, Co, Nb, Al and Ga respectively with 99.5% purity; being counted in atomic percent at %.

In order to precisely control the using proportioning of W, the content of W of the Dy, Tb, Fe, B, Cu, Co, Nb, Al and Ga used in the embodiment is under the limit of the existing devices, the selected Nd further comprises W, the content of W element is 0.01 at %.

The contents of each element are shown in TABLE 18:

TABLE 18

| Proportioning of each element (at %) | | | | | | | | | | |
|---|---|---|---|---|---|---|---|---|---|---|
| No. | Nd | Dy | Tb | B | Cu | Co | Nb | Al | Ga | Fe |
| 1 | 13.7 | 0.6 | 0.2 | 6.0 | 0.2 | 1.7 | 0.1 | 1.0 | 0.02 | remainder |
| 2 | 13.7 | 0.6 | 0.2 | 6.0 | 0.2 | 1.7 | 0.1 | 1.0 | 0.05 | remainder |
| 3 | 13.7 | 0.6 | 0.2 | 6.0 | 0.2 | 1.7 | 0.1 | 1.0 | 0.12 | remainder |
| 4 | 13.7 | 0.6 | 0.2 | 6.0 | 0.2 | 1.7 | 0.1 | 1.0 | 0.25 | remainder |
| 5 | 13.7 | 0.6 | 0.2 | 6.0 | 0.2 | 1.7 | 0.1 | 1.0 | 0.3 | remainder |
| 6 | 13.7 | 0.6 | 0.2 | 6.0 | 0.2 | 1.7 | 0.1 | 1.0 | 0.5 | remainder |
| 7 | 13.7 | 0.6 | 0.2 | 6.0 | 0.2 | 1.7 | 0.1 | 1.0 | 0.8 | remainder |
| 8 | 13.7 | 0.6 | 0.2 | 6.0 | 0.2 | 1.7 | 0.1 | 1.0 | 1.0 | remainder |

Preparing 100 Kg raw material of each sequence number group by respective weighing in accordance with TABLE 18.

Melting process: placing the prepared raw material into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace so that the Ar pressure would reach 35000 Pa, then obtaining a quenching alloy by being casted by single roller quenching method at a quenching speed of $10^{2}$° C./s~$10^{4}$° C./s, thermal preservation treating the quenching alloy at 550° C. for 10 minutes, and then being cooled to room temperature.

Hydrogen decrepitation process: at room temperature, vacuum pumping the hydrogen decrepitation furnace placed with the alloy, then filling hydrogen with 99.5% purity into the furnace until the pressure reach 0.085 MPa, after the alloy being placed for 160 minutes, vacuum pumping and heating at the same time, performing the vacuum pumping at 520° C. then being cooled, and the powder treated after hydrogen decrepitation process being taken out.

Fine crushing process: performing jet milling to a sample in the crushing room under a pressure of 0.42 MPa and in the atmosphere with oxidizing gas below 10 ppm, then obtaining an average particle size of 4.28 μm of fine powder. The oxidizing gas means oxygen or water.

Methyl caprylate is added into the powder treated after jet milling, the additive amount is 0.25% of the mixed powder by weight, further the mixture is comprehensively mixed by a V-type mixer.

Compacting process under a magnetic field: a transversed type magnetic field molder being used, compacting the powder added with methyl caprylate in once to form a cube with sides of 25 mm in an orientation field of 1.8 T and under a compacting pressure of 0.3 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.0 ton/cm$^2$.

Sintering process: moving each of the compact to the sintering furnace, firstly sintering in a vacuum of $10^{-3}$ Pa and respectively maintained for 3 hours at 300° C. and for 3 hours at 800° C., then sintering for 2 hours at 1030° C., after that filling Ar gas into the sintering furnace so that the Ar pressure would reach 0.1 MPa, then being cooled to room temperature.

Heat treatment process: annealing the sintered magnet for 1 hour at 600° C. in the atmosphere of high purity Ar gas, then being cooled to room temperature and taken out.

Machining process: machining the sintered magnet after heat treatment as a magnet with ϕ10 mm diameter and 5 mm thickness, the 5 mm direction being the orientation direction of the magnetic field.

Directly testing the sintered magnet manufactured according to the embodiments 1~8, and the magnetic property is evaluated. The evaluation results of the magnets of the embodiments are shown in TABLE 19 and TABLE 20.

TABLE 19

| Evaluation of the microstructure of the embodiments | | | | | | |
|---|---|---|---|---|---|---|
| No. | Average amount of W in the grain boundary (at %) | Ratio of W-rich phase in the magnet (vol %) | $WB_2$ phase | amorphous phase | isotropic phase | number of AGG |
| 1 | 0.088 | 10.0 | no | no | no | 8 |
| 2 | 0.089 | 10.1 | no | no | no | 1 |
| 3 | 0.090 | 10.0 | no | no | no | 0 |
| 4 | 0.093 | 10.01 | no | no | no | 0 |
| 5 | 0.092 | 9.98 | no | no | no | 0 |
| 6 | 0.090 | 9.99 | no | no | no | 1 |
| 7 | 0.090 | 10.1 | no | no | no | 1 |
| 8 | 0.089 | 10.0 | no | yes | yes | 1 |

The amorphous phase and isotropic phase of TABLE 19 investigate the amorphous phase and isotropic phase of the alloy.

The W-rich phase of TABLE 19 is a region with W content above 0.004 at % and below 0.26 at %.

TABLE 20

| Magnetic property evaluation of the embodiments | | | | | |
|---|---|---|---|---|---|
| No. | Br (kGs) | Hcj (kOe) | SQ (%) | (BH) max (MGOe) | BHH |
| 1 | 12.95 | 17.54 | 91.24 | 41.08 | 58.62 |
| 2 | 13.01 | 18.48 | 98.00 | 41.47 | 59.95 |
| 3 | 13.30 | 20.20 | 99.10 | 43.34 | 63.54 |
| 4 | 13.25 | 21.05 | 99.07 | 43.01 | 64.06 |
| 5 | 13.28 | 20.15 | 98.87 | 43.21 | 63.16 |
| 6 | 13.20 | 19.80 | 99.01 | 42.69 | 62.49 |
| 7 | 13.10 | 19.80 | 99.21 | 42.04 | 61.84 |
| 8 | 12.85 | 19.00 | 95.13 | 40.46 | 59.46 |

Through the manufacturing process, special attention is paid to the control of the contents of O, C and N, and the contents of the three elements O, C, and N are respectively controlled below 0.1~0.5 at %, 0.4 at % and 0.2 at %.

We may draw a conclusion that, when the content of Ga is below 0.05 at %, the dependency of heat treatment temperature of the coercivity may be increased, and the magnetic property is reduced, oppositely, when the content of Ga exceeds 0.8 at %, which induce the decrease of Br and (BH)max as Ga is a non-magnetic element.

Similarly, detecting embodiment 1~8 with FE-EPMA [Japanese electronic kabushiki kaisha (JEOL), 8530F], which also may be observed that, W performs a uniform pinning effect to the migration of the grain boundary with a high dispersity, and the formation of AGG is prevented.

Embodiment VIII

Raw material preparing process: preparing Nd, Dy, Gd and Tb respectively with 99.9% purity, B with 99.9% purity, and Cu, Co, Nb, Al and Ga respectively with 99.5% purity; being counted in atomic percent at %.

In order to precisely control the using proportioning of W, the content of W of the Dy, Gd, Tb, Fe, B, Cu, Co, Nb, Al and Ga used in the embodiment is under the detecting limit of the existing devices, the selected Nd further comprises W, the content of W element is 0.01 at %.

The contents of each element are shown in TABLE 21:

TABLE 21

| Proportioning of each element (at %) | | | | | | | | | | | |
|---|---|---|---|---|---|---|---|---|---|---|---|
| No. | Nd | Dy | Gd | Tb | B | Cu | Co | Nb | Al | Ga | Fe |
| 1 | 12.1 | 1 | 0.4 | 0.8 | 6.0 | 0.2 | 1.1 | 0.07 | 1.2 | 0.1 | remainder |
| 2 | 12.1 | 1 | 0.4 | 0.8 | 6.0 | 0.2 | 1.1 | 0.11 | 1.2 | 0.1 | remainder |
| 3 | 12.1 | 1 | 0.4 | 0.8 | 6.0 | 0.2 | 1.1 | 0.14 | 1.2 | 0.1 | remainder |
| 4 | 12.1 | 1 | 0.4 | 0.8 | 6.0 | 0.2 | 1.1 | 0.20 | 1.2 | 0.1 | remainder |
| 5 | 12.1 | 1 | 0.4 | 0.8 | 6.0 | 0.2 | 1.1 | 0.25 | 1.2 | 0.1 | remainder |

Preparing 100 Kg raw material of each sequence number group by respective weighing in accordance with TABLE 21.

Melting process: placing the prepared raw material into an aluminum oxide made crucible at a time, performing a vacuum melting in an intermediate frequency vacuum induction melting furnace in $10^{-2}$ Pa vacuum and below 1450° C.

Casting process: after the process of vacuum melting, filling Ar gas into the melting furnace so that the Ar pressure would reach 45000 Pa, then obtaining a quenching alloy by being casted by single roller quenching method at a quenching speed of $10^{2}$° C./s~$10^{4}$° C./s, thermal preservation treating the quenching alloy at 800° C. for 5 minutes, and then being cooled to room temperature.

Hydrogen decrepitation process: at room temperature, vacuum pumping the hydrogen decrepitation furnace placed with the alloy, then filling hydrogen with 99.5% purity into the furnace until the pressure reach 0.09 MPa, after the alloy being placed for 150 minutes, vacuum pumping and heating at the same time, performing the vacuum pumping at 600° C. then being cooled, and the powder treated after hydrogen decrepitation process being taken out.

Fine crushing process: performing jet milling to a sample in the crushing room under a pressure of 0.5 MPa and in the atmosphere with oxidizing gas below 30 ppm of, then obtaining an average particle size of 4.1 μm of fine powder. The oxidizing gas means oxygen or water.

Methyl caprylate is added into the powder treated after jet milling, the additive amount is 0.05% of the mixed powder by weight, further the mixture is comprehensively mixed by a V-type mixer.

Compacting process under a magnetic field: a transversed type magnetic field molder being used, compacting the powder added with aluminum stearate in once to form a cube with sides of 25 mm in an orientation field of 1.8 T and under a compacting pressure of 0.3 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.0 ton/cm$^2$.

Sintering process: moving each of the compact to the sintering furnace, firstly sintering in a vacuum of $10^{-3}$ Pa and respectively maintained for 3 hours at 200° C. and for 3 hours at 800° C., then sintering for 2 hours at 1050° C., after that filling Ar gas into the sintering furnace so that the Ar pressure would reach 0.1 MPa, then being cooled to room temperature.

Heat treatment process: annealing the sintered magnet for 2 hour at 480° C. in the atmosphere of high purity Ar gas, then being cooled to room temperature and taken out.

Machining process: machining the sintered magnet after heat treatment as a magnet with ϕ10 mm diameter and 5 mm thickness, the 5 mm direction being the orientation direction of the magnetic field.

Directly testing the sintered magnet manufactured according to the embodiments 1~5, and the magnetic property is evaluated. The evaluation results of the magnets of the embodiments are shown in TABLE 22 and TABLE 23.

TABLE 22

| Evaluation of the microstructure of the embodiments | | | | | | |
|---|---|---|---|---|---|---|
| No. | Average amount of W in the grain boundary (at %) | Ratio of W-rich phase in the magnet (vol %) | $WB_2$ phase | amorphous phase | isotropic phase | number of AGG |
| 1 | 0.089 | 9.99 | no | no | no | 1 |
| 2 | 0.088 | 9.98 | no | no | no | 0 |
| 3 | 0.091 | 10.0 | no | no | no | 0 |
| 4 | 0.093 | 10.01 | no | no | no | 0 |
| 5 | 0.092 | 10.02 | no | yes | yes | 0 |

The amorphous phase and isotropic phase of TABLE 23 investigate the amorphous phase and isotropic phase of the alloy.

The W-rich phase of TABLE 23 is a region with W content above 0.004 at % and below 0.26 at %.

TABLE 23

| Magnetic property evaluation of the embodiments | | | | | |
|---|---|---|---|---|---|
| No. | Br (kGs) | Hcj (kOe) | SQ (%) | (BH) max (MGOe) | BHH |
| 1 | 12.30 | 22.8 | 95.16 | 37.2 | 60.0 |
| 2 | 12.28 | 22.9 | 95.57 | 36.8 | 59.7 |
| 3 | 12.24 | 23.9 | 99.30 | 36.4 | 60.3 |
| 4 | 12.22 | 23.8 | 99.01 | 36.4 | 60.2 |
| 5 | 11.75 | 18.4 | 85.25 | 33.7 | 52.0 |

Through the manufacturing process, special attention is paid to the control of the contents of O, C and N, and the contents of the three elements O, C, and N are respectively controlled below 0.1~0.5 at %, 0.4 at % and 0.2 at %.

We may draw a conclusion that, when the content of Nb is above 0.2 at %, the amorphous phases is observed in the quenching alloy sheet as the increasing of the content of Nb, and Br and Hcj are reduced as the existence of amorphous phase.

Which is the same as the situation of adding Nb, by the experiments, the applicant found that the content of Zr should also be controlled below 0.2 at %.

Similarly, detecting embodiment 1~5 with FE-EPMA [Japanese electronic kabushiki kaisha (JEOL), 8530F], as the detecting results, which may be observed that, W performs a uniform pinning effect to the migration of the grain boundary with a high dispersity, and the formation of AGG is prevented.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A W-containing R—Fe—B—Cu serial sintered magnet, comprising:

an $R_2Fe_{14}B$-type main phase, the R being at least one rare earth element comprising Nd or Pr, wherein a crystal grain boundary of the W-containing R—Fe—B—Cu serial sintered magnet comprises a W-rich area with W content above 0.004 at % and below 0.26 at %, the W-rich area distributed with a uniform dispersion in the crystal grain boundary, and accounting for 5.0 vol % to 11.0 vol % of the W-containing R—Fe—B—Cu serial sintered magnet, wherein in the raw material of the W-containing R—Fe—B—Cu serial sintered magnet, R content is 12 at % to 15.2 at %, B content is 5 at % to 8 at %, W content is 0.0005 at % to 0.03 at %, Cu content is 0.05 at % to 1.2 at %, X content is below 5.0 at %, the X being selected from at least one element of Al, Si, Ga, Sn, Ge, Ag, Au, Bi, Mn, Nb, Zr or Cr, the total content of Nb and Zr is below 0.20 at % when the X comprises at least one of Nb or Zr, Co content is 0 at % to 20 at %, and the balance is Fe and inevitable impurities, and wherein O content of the W-containing R—Fe—B—Cu serial sintered magnet is 0.1 at % to 1.0 at %.

2. The W-containing R—Fe—B—Cu serial sintered magnet according to claim 1, wherein the content of X is below 2.0 at %.

3. The W-containing R—Fe—B—Cu serial sintered magnet according to claim 2, wherein the content of W is 0.005 at % to 0.03 at %.

4. The W-containing R—Fe—B—Cu serial sintered magnet according to claim 1, wherein the W-containing R—Fe—B—Cu serial sintered magnet is manufactured by the following steps:

producing an alloy for the W-containing R—Fe—B—Cu serial sintered magnet by casting a molten raw material with a composition of the W-containing R—Fe—B—Cu serial sintered magnet at a quenching speed of $10^{2}$° C./s to $10^{4}$° C./s;

producing a fine powder by firstly coarsely crushing and secondly finely crushing the alloy for the W-containing R—Fe—B—Cu serial sintered magnet;

obtaining a compact by a magnetic field compacting method; and sintering the compact in vacuum or inert gas at a temperature of 900° C. to 1100° C. to obtain the W-containing R—Fe—B—Cu serial sintered magnet.

5. The W-containing R—Fe—B—Cu serial sintered magnet according to claim 1, wherein the content of B is 5 at % to 6.5 at %.

6. The W-containing R—Fe—B—Cu serial sintered magnet according to claim 1, wherein the W-containing R—Fe—B—Cu serial sintered magnet has a content of Al of 0.8 at % to 2.0 at %.

7. The W-containing R—Fe—B—Cu serial sintered magnet according to claim 4, wherein:

the coarsely crushing comprises hydrogen decrepitating the alloy for the W-containing R—Fe—B—Cu serial sintered magnet to obtain a coarse powder, the finely crushing comprises jet milling the coarse powder, and the W-containing R—Fe—B—Cu serial sintered magnet is further manufactured by the following step:

removing at least one part of the fine powder with a particle size of smaller than 1.0 μm after the finely crushing, so that the fine powder which has a particle size smaller than 1.0 μm is reduced to below 10% of total powder by volume.

8. The W-containing R—Fe—B—Cu serial sintered magnet according to claim 1, wherein the W-containing R—Fe—B—Cu serial sintered magnet is manufactured by the following step:

treating the W-containing R—Fe—B—Cu serial sintered magnet by RH grain boundary diffusion, the RH being selected from at least one of Dy or Tb.

9. The W-containing R—Fe—B—Cu serial sintered magnet according to claim 8, wherein the W-containing R—Fe—B—Cu serial sintered magnet is further manufactured by the following step:

aging treating the W-containing R—Fe—B—Cu serial sintered magnet at a temperature of 400° C. to 650° C.

10. The W-containing R—Fe—B—Cu serial sintered magnet according to claim 1, wherein the content of O of the W-containing R—Fe—B—Cu serial sintered magnet is 0.1 at % to 0.5 at %.

11. The W-containing R—Fe—B—Cu serial sintered magnet according to claim 1, wherein the W-containing R—Fe—B—Cu serial sintered magnet has a content of Ga of 0.05 at % to 0.8 at %.

12. The W-containing R—Fe—B—Cu serial sintered magnet according to claim 1, wherein the W is comprised in the inevitable impurities.

13. A quenching alloy for W-containing R—Fe—B—Cu serial sintered magnet, wherein the quenching alloy comprises:

a W-rich area with W content above 0.004 at % and below 0.26 at %, the W-rich area distributed with a uniform dispersion in a crystal grain boundary, and accounting for at least 50 vol % of the crystal grain boundary;

wherein in the raw material of the W-containing R—Fe—B—Cu serial sintered magnet, R content is 12 at % to 15.2 at %, B content is 5 at % to 8 at %, W content is 0.0005 at % to 0.03 at %, Cu content is 0.05 at % to 1.2 at %, X content is below 5.0 at %, the X being selected from at least one element of Al, Si, Ga, Sn, Ge, Ag, Au, Bi, Mn, Nb, Zr or Cr, the total content of Nb and Zr is below 0.20 at % when the X comprises at least one of Nb or Zr, Co content is 0 at % to 20 at %, and the balance is Fe and inevitable impurities, and wherein O content of the W-containing R—Fe—B—Cu serial sintered magnet is 0.1 at % to 1.0 at %.

* * * * *